US008863447B2

(12) United States Patent
Bischoff et al.

(10) Patent No.: US 8,863,447 B2
(45) Date of Patent: Oct. 21, 2014

(54) HYBRID GEODESIC STRUCTURE

(76) Inventors: Gregory G. Bischoff, Reno, NV (US); Vicki P. Bischoff, Reno, NV (US)

( * ) Notice: Subject to any disclaimer, the term of this patent is extended or adjusted under 35 U.S.C. 154(b) by 0 days.

(21) Appl. No.: 13/450,273

(22) Filed: Apr. 18, 2012

(65) Prior Publication Data

US 2012/0260583 A1 Oct. 18, 2012

Related U.S. Application Data

(60) Provisional application No. 61/476,757, filed on Apr. 18, 2011.

(51) Int. Cl.
*E04B 7/08* (2006.01)
*E04B 1/32* (2006.01)

(52) U.S. Cl.
CPC ..... *E04B 1/3211* (2013.01); *E04B 2001/3252* (2013.01); *E04B 2001/3294* (2013.01); *E04B 2001/3247* (2013.01)
USPC ..... 52/81.1; 52/82; 52/81.3; 52/81.2

(58) Field of Classification Search
USPC ..... 52/80.1, 80.2, 81.4, 81.5, 81.1, 81.2, 52/81.3, 200, DIG. 10
See application file for complete search history.

(56) References Cited

U.S. PATENT DOCUMENTS 2,176,712 A * 10/1939 Hanson ..... 52/81.4
2,918,992 A * 12/1959 Gelsavage ..... 52/81.1
2,996,844 A * 8/1961 Paulson ..... 52/65
3,137,371 A * 6/1964 Nye ..... 52/81.2
3,583,490 A * 6/1971 McFadden ..... 169/60
3,810,336 A * 5/1974 Sadao ..... 52/81.2
3,857,213 A * 12/1974 Miyake ..... 52/86
3,909,994 A * 10/1975 Richter ..... 52/63
3,916,578 A * 11/1975 Forootan et al. ..... 52/167.4
3,999,337 A * 12/1976 Tomassetti et al. ..... 52/82
4,146,997 A * 4/1979 Diethorn ..... 52/81.4
4,159,603 A * 7/1979 Schroeder ..... 52/82
4,263,758 A * 4/1981 Seaich ..... 52/81.1
4,422,267 A * 12/1983 Whitehouse ..... 52/81.1
4,432,661 A 2/1984 Phillips et al.
4,464,073 A 8/1984 Cherry
4,491,437 A 1/1985 Schwartz
D280,665 S 9/1985 Miller
4,608,789 A * 9/1986 Willis ..... 52/81.1
4,611,441 A * 9/1986 Wickens ..... 52/81.4
4,625,472 A 12/1986 Busick
5,341,610 A * 8/1994 Moss ..... 52/82
5,452,555 A * 9/1995 Lee ..... 52/584.1
6,098,347 A * 8/2000 Jaeger et al. ..... 52/81.3
6,708,455 B1 * 3/2004 Niiduma ..... 52/81.2
6,996,942 B2 2/2006 Geiger
7,766,796 B2 * 8/2010 Pizmony ..... 482/35

* cited by examiner

*Primary Examiner* — Chi Q Nguyen
(74) *Attorney, Agent, or Firm* — Elizabeth E. Leitereg; J. Michael Johnson; North Shore Associates

(57) ABSTRACT

A hybrid geodesic structure includes a core structure and a geodesic shell surrounding the core structure. The core structure extends from a base at a center of the geodesic shell through an upper extent of the geodesic shell opposite to the base. The core structure supports the geodesic shell at an upper extent and includes a roof.

20 Claims, 5 Drawing Sheets

HYBRID GEODESIC STRUCTURE

CROSS-REFERENCE TO RELATED APPLICATIONS

This application claims priority from U.S. Provisional Patent Application Ser. No. 61/476,757, filed Apr. 18, 2011, the entire contents of which is incorporated herein by reference.

STATEMENT REGARDING FEDERALLY SPONSORED RESEARCH OR DEVELOPMENT

N/A

BACKGROUND

Geodesic domes have been available and in wide use for industrial, scientific and commercial applications and some residential applications for many years. Geometrically, a geodesic dome is a spherical shell structure made up of interlocking equilateral triangles and is of particular interest, because geodesic domes are extremely strong, inherently stable, and enclose more volume in less surface area. To some, a geodesic dome is substantially a half sphere. The geodesic dome may have a frequency of triangles or 'style' denoted as 2V, 3V, 4V, etc., depending on the number of edges that split up a larger triangle that makes up the geodesic dome. For example, when a basic triangle of the geodesic dome is divided into 4 smaller triangles, each side of the basic triangle is split into 2, i.e., a 2V-style. For the basic triangle divided into 9 smaller triangles, each side of the basic triangle is split into 3, i.e., a 3V-style geodesic dome, and so on. Each style has its advantages depending on one's point of view. For example, most geodesic dome structures for residential use on the market today tend to be some form of a 3V-style.

BRIEF DESCRIPTION OF THE DRAWINGS

Various features of examples in accordance with the principles described herein may be more readily understood with reference to the following detailed description taken in conjunction with the accompanying drawings, where like reference numerals designate like structural elements, and in which.

Figure 1:
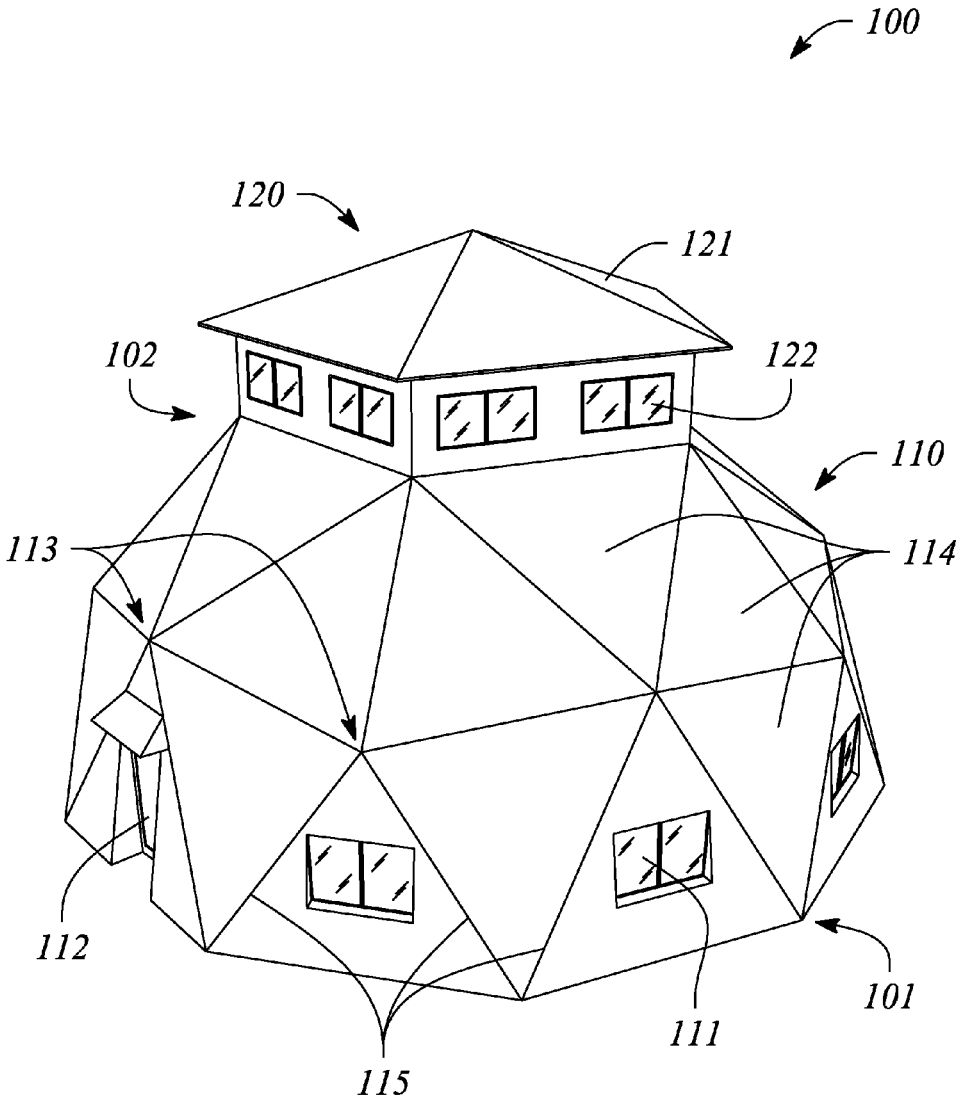
FIG. 1 illustrates a perspective view of a hybrid geodesic structure, according to an example of the principles described herein.

Certain examples have other features that are one of in addition to and in lieu of the features illustrated in the above-referenced figures. These and other features are detailed below with reference to the preceding drawings.

DETAILED DESCRIPTION

Examples in accordance with the principles described herein provide a hybrid geodesic structure that includes a geodesic shell surrounding a core structure. The core structure is located at a center of geodesic shell and extends from a base of the geodesic shell through an upper extent of the geodesic shell. In some examples, the core structure supports the geodesic shell at the upper extent and includes a roof. A portion of the core structure that extends through the upper extent of the geodesic shell may include a cupola that protrudes above the geodesic shell and may further include a window, according to some examples.

In some examples, the hybrid geodesic structure is a residential structure that provides permanent living space or temporary living space in an efficiently designed manner. For example, the core structure may house one or more of an electrical system, a mechanical system, a water system, and a sewage system for the hybrid geodesic structure. The core structure provides the systems in a centrally located, efficient and readily accessible manner in the hybrid geodesic structure, in some examples. In addition, the hybrid geodesic structure may be one or more of self-contained, energy producing, energy efficient, and easily assembled anywhere from a kit in some examples. Moreover, the hybrid geodesic structure may facilitate independent living, for example, without common public utilities, i.e., 'off-grid' living. In some examples, the hybrid geodesic structure may provide a cost effective and efficient way to facilitate independent living by addressing typical energy needs and disposal needs.

In some examples, the hybrid geodesic dome structures according to the principles described herein use fewer connectors to connect the geodesic shell struts than conventional 3V-style domes (e.g., about 26 versus about 46-61), which may allow for faster and more economical construction. Moreover, in some examples, the hybrid geodesic dome structures described herein have fewer triangular panels (e.g., less than about half the triangular panels than the 3V-style domes), such that the hybrid geodesic structures described herein may be larger and include more vertical flat interior wall surfaces. For example, more vertical flat surfaces provide for use of standard window and door sizes, which are more economical to use than custom sizes. Moreover, using fewer triangular panels means there are fewer seams between the panels for possible water intrusion; and sealing and waterproofing of the hybrid geodesic structures described herein may make the structures more economical, for example.

As used herein, the article 'a' is intended to have its ordinary meaning in the patent arts, namely 'one or more'. For example, 'a strut' means one or more struts and as such, 'the strut' means 'the strut(s)' herein. Also, any reference herein to 'top', 'bottom', 'upper', 'lower', 'up', 'down', 'front', back', 'left' or 'right' is not intended to be a limitation herein. Herein, the term 'about' when applied to a value generally means within the tolerance range of the equipment used to produce the value, or in some examples, means plus or minus 10%, or plus or minus 5%, or plus or minus 1%, unless otherwise expressly specified. The term 'substantially' is used herein to mean all or completely, almost all or mostly, predominately, or more than half. Moreover, examples herein are intended to be illustrative only and are presented for discussion purposes and not by way of limitation.

FIG. 1 illustrates a perspective exterior view of a hybrid geodesic structure 100, according to an example of the principles described herein. The hybrid geodesic structure 100 comprises a geodesic shell 110 and a core structure 120 in a center of the geodesic shell 110. As illustrated, the core structure 120 has a pentagonal shape and is referred to herein as a 'pentagonal core structure' although other shapes are within the scope of the principles described herein including, but not limited to, various other polygonal shapes, a circular shape, a curvilinear shape, or an elliptical shape, for example. The geodesic shell 110 has a base 101 adjacent to a foundation of the hybrid geodesic structure 100 and an upper extent 102 that is opposite to the base 101. In FIG. 1, a cupola of the pentagonal core structure 120 extends up from the upper extent 102 of the geodesic shell 110. The cupola has a roof 121 and in some examples, a window 122 (e.g., a plurality of windows 122 are illustrated by way of example) for one or both of ventilation and natural light, for example. Not illustrated in this perspective exterior view of the hybrid geodesic structure 100 of FIG. 1 is that the cupola is a part of a second level of the pentagonal core structure 120 that has a contiguous first level that extends down to the base 101 at the center of the geodesic shell 110. Further illustrated in FIG. 1 are a plurality of windows 111 and a door 112 for ingress to and egress from an interior of the hybrid geodesic structure 100.

The geodesic shell 110 comprises a plurality of shell framing struts attached together at corners 113 with connectors to form a shell lattice and a plurality of triangular shaped panels 114 attached to the framing struts to enclose the shell lattice. The geodesic shell 110 surrounds the core structure 120. The attached triangular shaped panels 114 are further sealed at seams 115 between the panels 114 to provide one or more of waterproofing, weatherproofing and energy-efficiency to the geodesic shell 110.

Figure 2:
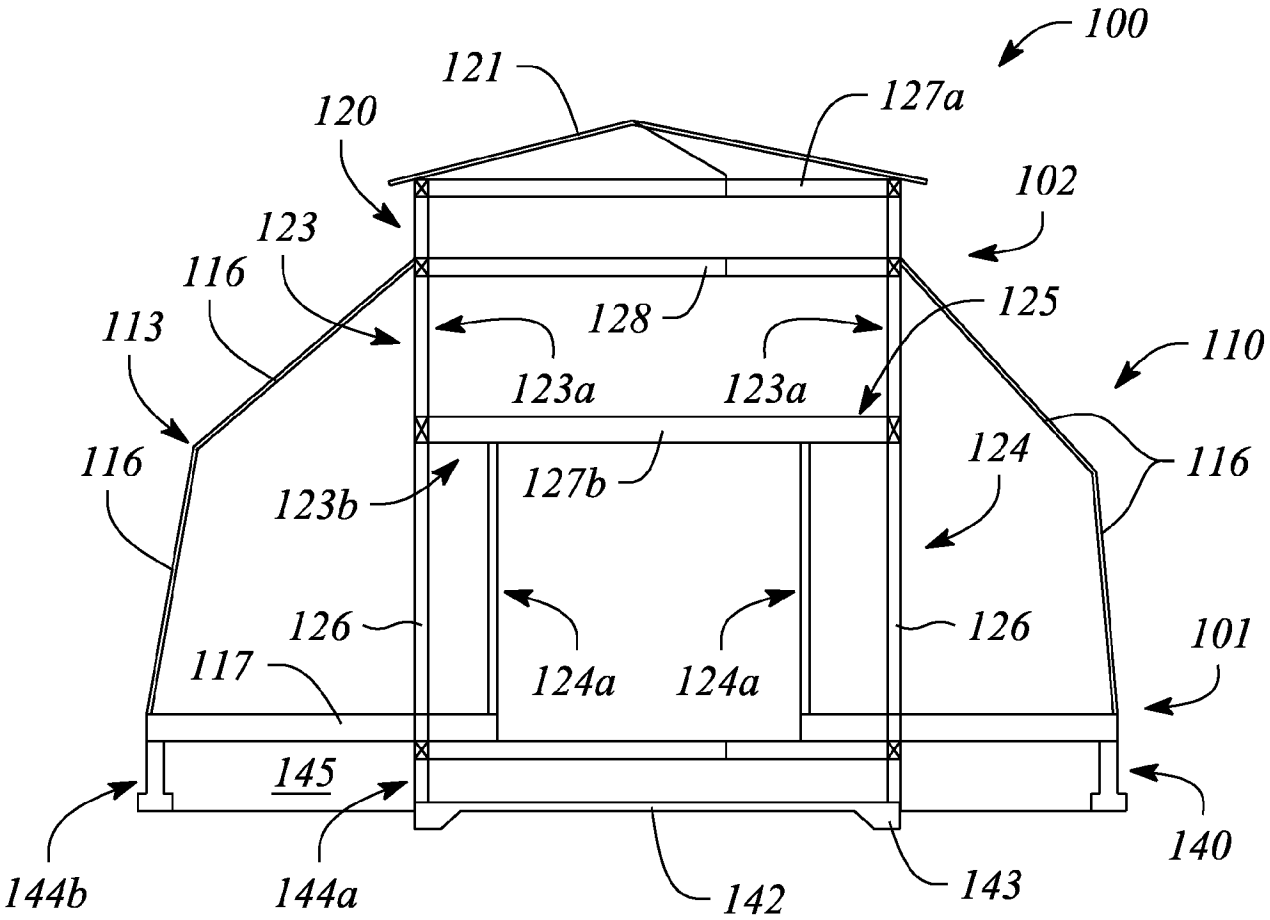
FIG. 2 illustrates a cross section of a hybrid geodesic structure, according to another example of the principles described herein.

FIG. 2 illustrates a cross-sectional view of a hybrid geodesic structure 100 according to another example of the principles described herein. As illustrated in FIG. 2, the core structure 120 extends from a first end at a foundation 140 that is adjacent to the base 101 of the geodesic shell 110 to a height above the upper extent 102 of the geodesic shell 110 at a second end. Both the second level 123 and the first level 124 of the core structure 120 are illustrated in FIG. 2. In some examples, the first level 124 of the core structure 120 is delineated by the base 101 of the geodesic shell 110 and a second level floor 125 at opposite ends. Moreover in some examples, the second level 123 is delineated by the second level floor 125 (i.e., contiguous upper and lower levels) and the roof 121 at opposite ends. In some examples, the floor space on the second level 123 is larger than and overhangs the first level 124 of the core structure 120. For example, second level walls 123*a* are spaced farther apart from each other than first level walls 124*a* are spaced apart such that the second level 123 forms an overhang 123*b*, as illustrated in FIG. 2 by way of example.

In some examples, the core structure 120 is constructed with a plurality of vertical posts 126 arranged to define a shape corresponding to the core shape. The vertical posts 126 originate in the foundation 140 at the first end and extend to a height above the upper extent 102 of the geodesic shell 110 at the second end opposite to the first end. For example, the vertical posts 126 may extend substantially to the roof 121. In some examples, the vertical posts 126 are interconnected with about four sets of horizontal structural rings of beams or struts spaced along a vertical length of the vertical posts 126 from the first end (e.g., in the foundation 140) to the second end (e.g., adjacent to the roof) of the vertical posts 126. The four sets of horizontal beams or struts facilitate support of the core structure 120.

For example, a first set 127*a* includes horizontal beams that outline the shape of the core structure 120 at the second end or the top of the vertical posts 126. The first set 127*a* of horizontal beams also supports the roof 121. The second set 128 includes horizontal struts at the upper extent 102 of the geodesic shell 110. The second set 128 outline an opening in the framing strut lattice of the geodesic shell 110 through which the core structure 120 extends. The vertical posts 126 support the geodesic shell 110 with the second set 128 of horizontal struts at the upper extent 102, for example. A third set 127*b* includes horizontal beams that outline the shape of the core structure 120 at the second level floor 125. The third set 127*b* further supports the second level 123 and floor joists of the second level floor 125, for example. A fourth set 144*a* includes horizontal beams that outline the shape of the core structure 120 in a vicinity of the foundation 140 of the hybrid geodesic structure 100 (e.g., at or just below a first level or base 101 of the geodesic shell 110). The fourth set 144*a* of horizontal beams may be a portion of a pony wall with or between the vertical posts 126, for example. The pony wall may extend in the foundation 140 and provide support for the first level floor joists 117. As such, the fourth set 144*a* is also referred to herein as a 'core pony wall 144*a*' and is further described below.

In some examples, the first level 124 of the core structure 120 provides a central location for components of one or more of mechanical systems, electrical systems, and water systems, as well as laundry equipment and storage. Moreover in some examples, the first level 124 of the core structure 120 provides a central access to a crawl space 145 of the foundation 140, as further described below. The central location of system components on the first level 124 of the core structure 120 facilitates efficient routing of electrical wiring and mechanical and plumbing components in the crawl space 145 for the hybrid geodesic structure 100, for example.

In some examples, the hybrid geodesic structure 100 further comprises a foundation, for example the illustrated foundation 140 adjacent to and contiguous with the base 101 of the geodesic shell 110. In some examples, the foundation is a concrete slab foundation or in other examples, the foundation 140 comprises a concrete slab 142 and a foundation stem wall 144*b* such that the crawl space 145 is provided between at least the concrete slab 142 and a plurality of first level floor joists 117 at the base 101 of the geodesic shell 110. As mentioned above, the core pony wall 144*a* is located in the foundation 140. A 'pony wall' is defined herein with respect to the foundation 140 as a relatively short wall that is located between the soil or a footing in the soil and the base 101 of the geodesic shell 110 that supports the first level floor joists 117. A 'stem wall' is defined herein with respect to the foundation 140 a relatively short foundation wall that supports exterior vertical walls and is located between the soil or a footing in the soil and the first level floor joists 117. The foundation stem wall 144*b* also supports the first level floor joists 117. A 'footing' as defined herein is a portion of the foundation 140 that is embedded in the soil that attaches to and provides support to the core pony wall 144*a* and the foundation stem wall 144*b*.

In some examples, the concrete slab may extend the full extent of the foundation 140. In other examples, the concrete slab 142 extends for a portion of the foundation 140, as illustrated in FIG. 2. In some examples, the concrete slab 142 is located approximately at the center of the hybrid geodesic structure 100 and has portions 143 that are relatively thicker (e.g., footings) that facilitate structural support of the vertical posts 126 of the core structure 120 at the foundation 140. For example, the concrete slab 142 may have a substantially pentagonal shape with the thicker edge portions 143 at five corners to correspond with the locations of the vertical posts 126 of the pentagonal core structure 120. In other examples, the concrete slab 142 may be some other shape with thickened portions 143 that correspond to the respective shape of the core structure 120. The core pony wall 144*a* (i.e., the fourth set 144*a* of horizontal beams), outlines the vertical posts 126 that enclose the core structure 120; and the foundation stem wall 144*b* outlines the base 101 of the geodesic shell 110 and support the geodesic shell 110.

FIG. 2 further illustrates a plurality of struts 116 of the geodesic shell 110. The struts 116 may be made from structural grade dimensional lumber (e.g., '2×4', '2×6', or '4×8' lumber, wherein the numerical values are in approximate inches (")), or steel tubes or studs, for example. According to some examples, the struts 116 are assembled into a geodesic shell lattice of interconnected triangles. The triangular shaped panels 114 (see FIG. 1) are then attached to the struts 116 of the lattice to enclose the geodesic shell 110. The struts 116 of the various triangles are interconnected using connectors. In other examples, the struts 116 may be integral to the triangular shaped panels 114 and the connectors are used to interconnect the combined struts 116 and triangular shaped panels 114 at corners 113 to both provide structural integrity to and enclose the geodesic shell 110.

Figure 3A:
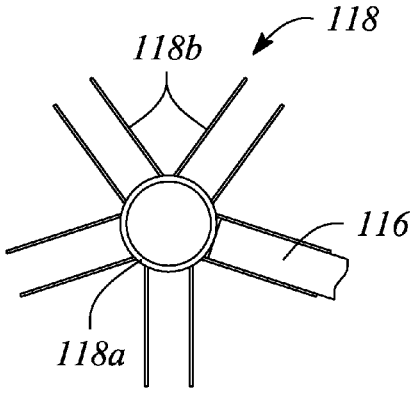
FIGS. 3A-3D illustrate plan views of various example connectors used to construct a hybrid geodesic structure, according to an example of the principles described herein.
Figure 3B:
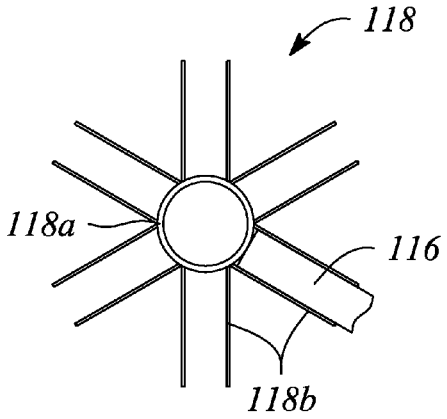
Figure 3C:
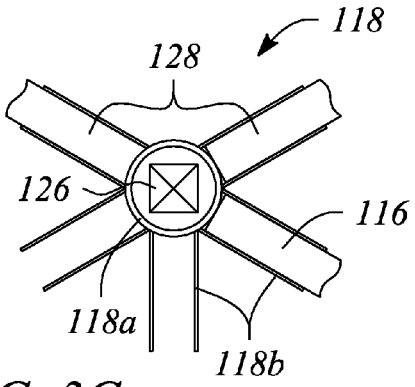
Figure 3D:
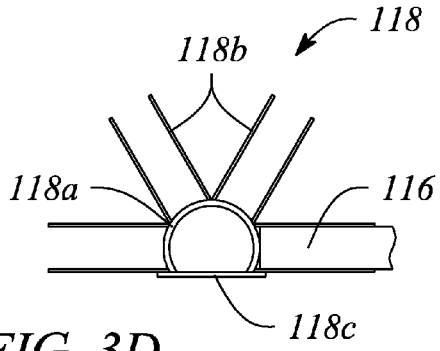

FIGS. 3A-3D illustrates plan views of various connectors 118 used to construct a hybrid geodesic structure 100, according to an example of the principles described herein. In some examples, the connectors 118 comprise a length of pipe 118*a* and pairs of straps 118*b* attached (e.g., welded) to the pipe 118*a* to extend radially from the pipe 118*a*. For example, the pipe 118*a* may be a schedule 40 steel pipe that is about two inch long; and the straps 118*b* may be about one-eight inch (") thick, about 2" wide and about 10" long steel straps, for example. Each pair of straps 118*b* has about two pairs of through holes to accommodate bolts of about five-eighth inch, for example. The struts 116 fit within the pairs of straps 118*b* and are bolted to the straps 118*b*. FIG. 3A illustrates a 5-way connector 118 with five pairs of straps 118*b* attached to the pipe 118*a*. The 5-way connector 118 connects a five-triangle strut assembly of the geodesic shell lattice. FIG. 3B illustrates a 6-way connector 118 with six pairs of straps 118*b* attached to the pipe 118*a*. The 6-way connector 118 connects a six-triangle strut assembly of the geodesic shell lattice. FIG. 3C illustrates a modified 6-way connector 118 with five pairs of straps 118*b* attached to the pipe 118*a*. The modified 6-way connector 118 connects the struts 116 adjacent to the upper extent 102 of the geodesic shell 100 to the core struts 128 (the second set 128 of horizontal ring struts) and to the vertical posts 126 of the core structure 120, according to some examples. In particular, the vertical post 126 is coaxially positioned in and connected to the steel pipe 118*a*. FIG. 3D illustrates a 4-way connector 118 with four pairs of straps 118*b* attached to a modified pipe 118*a* to accommodate a substantially flat plate 118*c*, for example. The 4-way connector 118 is used to connect others of the struts 116 substantially to the foundation stem wall 144*b* at the base 101. The connectors 118 may be made from a metal including, but not limited to, steel, another structural material used for connectors (e.g., aluminum), an alloy of two or more metals, or a combination of a metal and another structural material, for example.

As mentioned above, the geodesic shell 110 comprises triangular shaped panels 114 that attach to the struts 116 of the geodesic shell 110. In some examples, the triangular shaped panels 114 include a structural insulated (or insulating) panel (SIP). A 'SIP' is defined herein as a composite building material that comprises an insulating layer of a rigid polymer material, for example a polymer foam such as expanded polystyrene (EPS) or polyurethane, that is sandwiched between layers of a substantially planar structural construction material. The substantially planar structural construction material may include, but is not limited to, plywood, oriented strand board (OSB) or another wood-based planar structural construction material, a cement-based planar structural construction material (e.g., cement board), a metal-based planar structural material (e.g., sheet metal, corrugated steel sheets, etc.), or a combination of any of these, for example. In some examples, the planar structural construction material may be used in combination with a gypsum plaster-based board material (e.g., drywall) that is substantially non-structural to realize the SIP. For example, the SIP insulating layer may be sandwiched between the planar structural construction material on one side and the gypsum plaster based board material on an opposite side. The planar structural construction material may form or be adjacent to an exterior surface of the geodesic shell 110 while the gypsum plasterboard material may form or be adjacent to an interior surface. The triangular SIPs may be prefabricated and for example, prefabricated to preselected specifications. In some examples, the geodesic shell 110 comprises a modified SIP. The modified SIP may have a prefabricated opening for a window or door in the SIP, for example, or another customized structural feature such as structural blocking or additional framing within the panel to support a customized design.

In some examples, the triangular shaped panels 114 are fabricated using stick framing. 'Stick framing' is defined herein as manual construction, for example at the construction site, of a structure being built, and allows for on-the-spot customization. In some examples, a stick-framed triangular shaped panel 114 is sheathed on one side with the planar structural construction material (e.g., one or more of plywood, OSB, cement board, sheet metal, or a combination thereof) for example. The stick-framed panel 114 is then insulated using a fiberglass insulation or a foam-based insulation, for example, and then sheathed on the other side to cover the insulation, for example as described above. For a '2×4' construction, the triangular shaped panels 114 are no less than 4 inches thick; for a '2×6' construction, the triangular shaped panels 114 are no less than 6 inches thick; and for a '4×8' construction, the triangular shaped panels 114 are no less than 8 inches thick, for example. The thicker the panel the thicker the insulation can be within the panel such that insulation ratings from a value of about R-20 to about R-30 for the walls and about R-30 to about R-40 for the roof are possible, for example. Plywood sheathing on the triangular shaped panels may be about three-quarters of an inch thick, for example.

According to some examples, the triangular shaped panels 114 for the hybrid geodesic structure 100 are of two sizes that include, but are not limited to, one or both of substantially equilateral triangular panels and substantially isosceles triangular panels. In other examples, there may be only one size or alternatively, more than two different sizes of the triangular shaped panels, which depends in part on the style of geodesic dome, e.g., 2V-style, 3V-style, etc. For example, the geodesic shell 110 characterized by a 2V-style geodesic dome may have a plurality of triangular shaped panels 114 that are equilateral triangular panels of a first size and another plurality of triangular shaped panels 114 that are isosceles triangular panels of a second size. Sides (e.g., strut lengths) of the equilateral triangular panels (referred to herein as an 'E-panel' for simplicity) may have a length A (e.g., in feet), while the isosceles triangular panels (referred to herein as an 'I-panel' for simplicity) may have two sides that both have a length B (e.g., also in feet) and a third side of the length A, for example.

In some examples, the hybrid geodesic structure 100 further includes one or more systems of Living Infrastructure Equipment (LIFE). 'LIFE' is defined herein as equipment used to live substantially independently of public utilities, e.g., water, sewer, and power, and in some examples, to leave a 'small' environmental footprint. In some examples, the LIFE consists of two separate systems, an electrical system and a water system. The electrical system creates energy using photovoltaic collectors (PV), stores the created energy in a battery bank, and delivers the created energy to lights, fans and pumps, and various power outlets to run appliances, for example. According to various examples, the water system comprises one or more of pumps, tanks, solar thermal collectors, heat exchangers, and a delivery system to supply both domestic hot and cold water. In some examples, the water system may further comprise heated water for radiant heating or heating using another heat exchanger (e.g. a forced air heat exchanger). In some examples, the water system may further comprise separate waste disposal lines for gray water and black water. For example, human waste may be processed through one or more of a septic system, a composting toilet or an incinerating toilet (i.e., black water). In some examples, the water system may further comprise a gray water collection system that may be used for garden or landscape watering, for example. In some examples, one or more of a wind power-generating system, a photovoltaic power-generating system, with or without battery storage capacity, and a thermal water heating system may be included as a part of LIFE. In some examples, the LIFE systems or portions thereof may be housed in the first level 124 of the core structure 120 with associated plumbing and wiring being routed in the crawl space 145 and readily accessible in a central location of the hybrid geodesic structure 100.

In some examples of the principles described herein, a kit for constructing a hybrid geodesic structure is provided. The hybrid geodesic kit includes components to form a geodesic shell, for example the geodesic shell 110 described above. The kit further includes materials to form a core structure, for example the core structure 120 described above. In particular, the kit comprises the materials and supplies to construct the geodesic shell to surround the core structure and the core structure to extend from a foundation of the hybrid geodesic structure to a height above an upper extent of the geodesic shell in a center of the geodesic shell. In some examples, the kit comprises pre-fabricated struts and pre-fabricated triangular shaped panels for the geodesic shell and roof, and further comprises lumber for the core structure, for example the vertical posts, horizontal beams and struts and roof framing members. The kit further comprises means for connecting the struts together into a shell lattice, means for attaching the triangular panels to the struts, and means for connecting the core structure to the geodesic shell at the upper extent. In some examples, the kit further comprises means for weather proofing the geodesic shell, for example a seam sealer for the seams between triangular panels. In some examples, the kit provides the materials and supplies for constructing the hybrid geodesic structure 100 as described above.

For example, the hybrid geodesic structure made using the kit has a main level living space provided by the geodesic shell that surrounds the core structure. The hybrid geodesic structure made using the kit further has a first level of the core structure that provides a central location for the systems of the LIFE described above, laundry and storage, for example, and may have accessibility to the foundation via a crawl space, for example. The hybrid geodesic structure made using the kit further has a second level of the core structure above the first level that provides further living space. For example, the kit comprises materials for a cupola with windows for natural light and ventilation in the second level. In some examples, the kit further includes windows and a door for installation in the geodesic shell at the main level.

In some examples, the hybrid geodesic kit further includes materials and supplies for one or both of an exterior finishes package and an interior finishes package. For example, the exterior finishes package may include an exterior siding material including, but not limited to, one or more of stucco, wood siding, a composite material siding and stone. For example, a composite material may be included that is one or more of mixable, trowelable, waterproof and has a one hour fire rating. The composite material may be a three layer system that includes a light weight plastic mesh layer applied over plywood walls, for example the sheathing of the triangular shaped panels, and a sealant paste layer troweled over the plastic mesh. The plastic mesh layer and sealant paste layer will substantially seal all the plywood seams between the triangular shaped panels and may smooth out the seams as well. A final layer of the composite material may provide a preselected texture and color to the exterior of the hybrid geodesic structure. The interior finishes package may include, but is not limited to, drywall, wall texturing, paneling, paint and a combination thereof, for example. In some examples, the interior finishes package may further include, but is not limited to, one or more of plumbing fixtures, electrical fixtures, cabinets, counter tops, and flooring.

In some examples, the hybrid geodesic structure kit further includes one or more of an electrical system, a mechanical system, a water system, and a sewage system of a LIFE package to be housed in the core structure. For example, one or more of these systems may be housed in the first level 124 of the core structure 120 of the hybrid geodesic structure 100 and accessible via the crawl space 145 in the foundation 140 of the hybrid geodesic structure 100. In some examples, the LIFE package comprises the electrical system (e.g., photovoltaic or wind system, batteries, and lighting) and plumbing and heating equipment (e.g., solar thermal hot water and radiant heating, water pumps, storage tanks, and grey and waste water systems). In some examples, the hybrid geodesic kit provides one or more LIFE systems for off-grid, self-sufficient living, i.e., substantially without public utilities.

In an example of the principles described herein, a hybrid geodesic dome structure is described. The example hybrid geodesic dome has a 2V-style geodesic shell with ten sides at the base and a pentagonal core structure at the center of the geodesic shell. The pentagonal core structure extends from a foundation of the hybrid geodesic dome to above the upper extent of the geodesic shell. The example hybrid geodesic dome is about thirty-nine feet in diameter, about nineteen and one-half feet high, and the pentagonal core structure is about twelve feet on a side and may exceed the geodesic dome height by about three feet or more. In some examples, the hybrid geodesic dome structure is substantially the same as the hybrid geodesic structure 100 described above.

The geodesic shell of the example hybrid geodesic dome may be constructed using about four inch by about eight inch (4"×8") dimensional lumber struts in two strut sizes of about twelve feet ('A-struts') and about ten and six-tenths feet ('B-struts') lengths, respectively. There may be about thirty-five A-struts and about thirty B-struts to form a geodesic lattice of the geodesic shell (e.g., the geodesic shell 110). About twenty-six connectors of about four different connector types are employed to connect together the various struts, for example. For example, the connectors may comprise about six 5-way connectors, about five 6-way connectors, about ten 4-way connectors and about five modified 6-way connectors. The modified 6-way connectors may be employed to connect the geodesic lattice to the pentagonal core structure, for example. In some examples, light slopeable/skewable U (LSU/LSSU) hangers, for example from Simpson Strong-Tie Co., Inc., Pleasanton, Calif., may be used to connect struts or beams to the vertical posts. For example, referring back to FIGS. 1 and 2, there may be three shell struts 116 connecting to the core structure 120, wherein a middle shell strut of the three may connect directly to the vertical posts 126 of the core structure 120; and the other two shell struts of the three shell struts may connect directly to the second horizontal ring struts of the second set 128. In another example, the 4-way connector comprises a steel pipe cut and welded to a flat bottom plate. The bottom plate may have a hole drilled in the center, to enable the bottom plate to be bolted to the foundation with a SSTB® anchor bolt, a registered trademark of Simpson Strong-Tie Co., Inc., for example. In some examples, the connectors 118 illustrated in FIGS. 3A-3D may be used.

The example hybrid geodesic shell has triangular SIP panels, for example, of about two sizes to fit within spaces of the geodesic strut lattice to form the geodesic shell. For example, quantities of about thirty I-panels and about ten E-panels may be used, wherein the length B of the I-panels is substantially the same as the B-strut length and the length A of the I-panels and the E-panels is substantially the same as the A-strut length. Some of the SIP panels may be modified to support windows and doors of the example hybrid geodesic dome.

In some examples, the pentagonal core structure is constructed using post and beam construction, for example using construction-grade wood. A cupola roof is installed on the pentagonal core structure with some of the triangular SIP panels supported by horizontal ring beams at the second end of the core structure (e.g., the first set of horizontal ring beams 127*a* of the hybrid geodesic structure 100). First and second levels in the pentagonal core structure may have a ceiling height of about ten and one-half feet and include a cupola with windows that is contiguous with the second level. In some examples, the second horizontal ring struts (e.g., the second set 128 of the core structure 120) and third horizontal ring beams of the core structure (e.g., the third set of horizontal ring beams 127*b* of the core structure 120) may be attached to the vertical posts of the core structure with skewed HUSC face-mount hangers, also from Simpson Strong-Tie Co., Inc., for example.

The example hybrid geodesic dome may have one or more of (i) about seven and one-half inches thick exterior walls, (ii) an R-30 value foam insulation in the shell SIP panels and (iii) an R-40 value foam insulation for roof SIP panels. The roof may be sheathed using pre-cut standing seam metal roofing and the exterior of the example hybrid geodesic dome may be coated with a composite membrane material to seal and waterproof the structure. In some examples, the example hybrid geodesic dome may be a residential dwelling having one bedroom and one bath or three bedrooms and two baths, for example, in about one thousand-four hundred square feet of living space. As such, windows and doors are added accordingly. In some examples, the example hybrid geodesic dome is substantially the same as the hybrid geodesic structure 100 described above.

Figure 4:
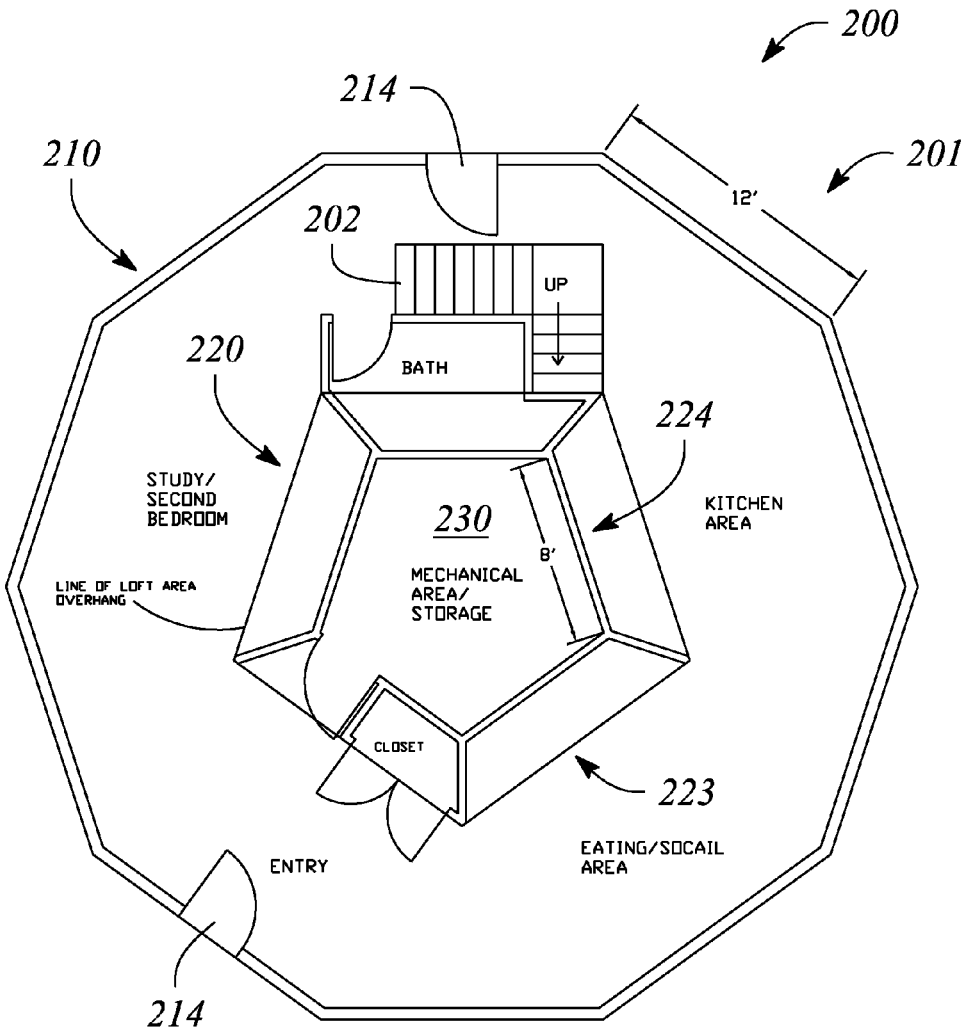
FIG. 4 illustrates a plan view of a main level floor plan of a hybrid geodesic dome, according to an example of the principles described herein.

FIG. 4 illustrates a main level floor plan 201 for a hybrid geodesic dome 200, according to an example of the principles described herein. The hybrid geodesic dome 200 has a geodesic shell 210 and a central pentagonal core structure 220. As illustrated in FIG. 4, the main level floor plan 201 includes, but is not limited to, a kitchen area, an eating/social area, a study or bedroom area, a bathroom, and a closet. Each of ten sides at the base of the geodesic shell 210 is about twelve feet wide and each of five sides of a first level 224 of the pentagonal core structure 220 is about eight feet wide. Moreover, there are two means 214 of ingress and egress for the geodesic shell 210 provided in this example main level floor plan 201. Although not illustrated in FIG. 4, a plurality of windows may be located in the sides of the geodesic shell 210 on the main level floor plan 201 (e.g., as illustrated in FIG. 1). Central to the hybrid geodesic dome 200 is the mechanical area 230 and storage on the main level within the first level 224 of the pentagonal core structure 220. The mechanical area 230 may have access to a crawl space (not illustrated) for plumbing, wiring and the like, for the hybrid geodesic dome 200. The mechanical area 230 includes, but is not limited to, at least a portion of, or components of, one or more of an electrical system, a mechanical system, a water system, a sewage system and systems of LIFE.

Figure 5:
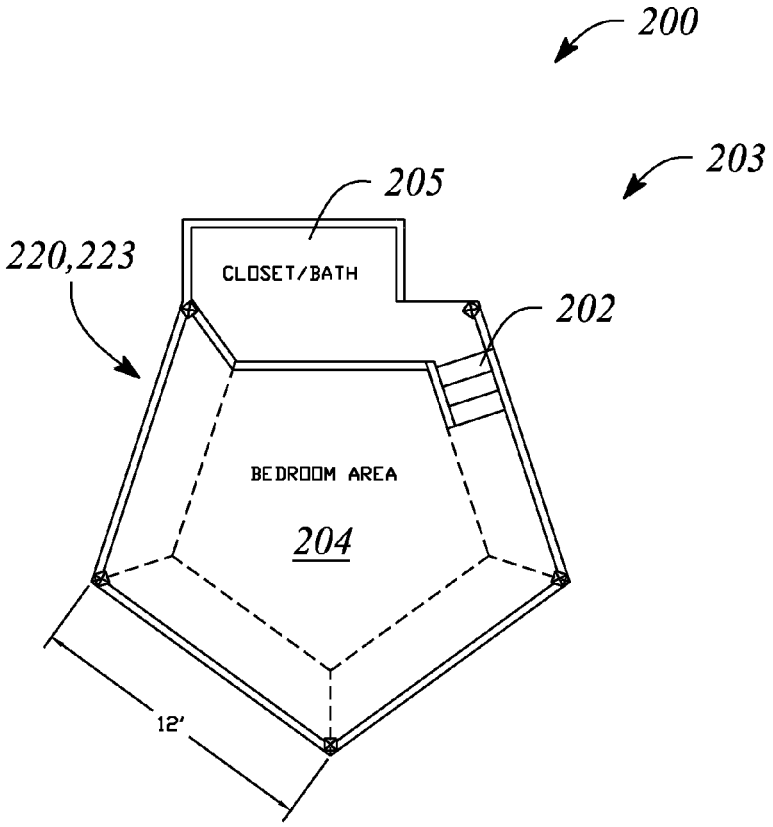
FIG. 5 illustrates a plan view of a second level floor plan of the hybrid geodesic dome in FIG. 4, according to an example of the principles described herein.

The example hybrid geodesic dome 200 further comprises a second level 223 in the pentagonal core structure 220. In particular, the pentagonal core structure 220 is two stories and extends from the main level through the center of the geodesic shell 210 to extend from an upper extent of the geodesic shell 210. As such, a set of stairs 202 is also included in the main level floor plan 201 that connects to the second level 223. FIG. 5 illustrates a plan view of a second level floor plan 203 of the hybrid geodesic dome 200 of FIG. 4, according to an example of the principles described herein. The second level floor plan 203 is about twelve feet on a side and includes, but is not limited to, one or more of a bedroom area, other living space, a bathroom, and a closet, for example. The second level 223 may be referred to as a loft area in some examples, and may be fully enclosed or partially enclosed. As illustrated in FIG. 5, the second level floor plan 203 includes a first portion 204 of the second level 223 that is at a top of the set of stairs 202 and a smaller, second portion 205 of the second level 223 adjacent to and accessible by the stairs 202 that is at a lower level than the first portion 204, for example. In some examples, the smaller, second portion 205 may be about one-quarter of the set of stairs lower than the first portion 204, or about three feet lower. In some examples, the lower location of the smaller, second portion 205 facilitates headroom. The smaller, second portion 205 may include one or both of a closet and a second bathroom, while the first portion 204 may include a living area, for example a second bedroom. In another example, the closet may be located in the first portion 204, such that the smaller, second portion 205 may include a larger or 'master' bathroom and the second level floor plan 203 may be for a master bedroom suite.

Referring again to FIG. 4, the second level 223 of the pentagonal core 220 is larger than and overhangs the first level 224 of the pentagonal core structure in some examples. This is also illustrated in cross section in FIG. 2, for example see first level walls 124*a* and second level walls 123*a* and overhang 123*b*. The larger, overhanging second level 223 provides more living space and floor plan options, for example, on the second level 223 and concomitantly, the smaller first level 124 allows for more living space and storage options, for example, around the periphery of the pentagonal core structure 220 on the main level. In some examples, the floor plans 201, 203 provide efficient use of space and energy usage as well as a comfortable interior climate. For example, with the second level living space being in a core structure that is away from the geodesic shell walls, the hybrid geodesic structure provides more ceiling height in the center of the shell to provide more living space than without the core structure.

In some examples, airflow to all parts of the hybrid geodesic structure may be enabled or enhanced by the hybrid geodesic structure. For example, the second level of the hybrid geodesic structure may be enclosed by about six foot high walls that may allow for improved air flow and enhanced heating and cooling efficiency. In some examples, the hybrid geodesic structures, in accordance with the principles described herein, may offer more usable space with higher headroom than conventional dome structures. Moreover, the centrally located mechanical room or utility space on the main level of the core structure may further support a more efficient use of space and materials compared to conventional dome structures.

Thus, there have been described examples of a hybrid geodesic structure employing a core structure and a kit providing same. It should be understood that the above-described examples are merely illustrative of some of the many specific examples that represent the principles described herein. Clearly, those skilled in the art can readily devise numerous other arrangements without departing from the scope as defined by the following claims.

What is claimed is:

1. A hybrid geodesic structure comprising:

a core structure comprising a plurality of vertical posts arranged to define a polygonal shape of the core structure; and a set of structural members that interconnect with vertical posts along a vertical length of the vertical posts to form a horizontal structural ring; and a geodesic shell surrounding the core structure, the core structure extending from a base of the geodesic shell through an upper extent of the geodesic shell opposite to the base at a center of the geodesic shell and further comprising a roof above the geodesic shell, the core structure supporting the geodesic shell at the upper extent.

2. The hybrid geodesic structure of claim 1, wherein the core structure further comprises a cupola under the roof, the cupola having a window and protruding from the upper extent of the geodesic shell.

3. The hybrid geodesic structure of claim 1, further comprising one or more of an electrical system, a mechanical system, a water system, and a sewage system, a portion of which being located in the core structure.

4. The hybrid geodesic structure of claim 1, wherein the geodesic shell has a 2V-style, the core structure being a pentagonal core structure.

5. The hybrid geodesic structure of claim 1, wherein the geodesic shell comprises a lattice of struts in about two sizes and shell panels of a triangular shape that attach to the struts to fill openings in the lattice, the shell panels being in about two sizes.

6. The hybrid geodesic structure of claim 1, wherein the core structure is a pentagonal core structure.

7. The hybrid geodesic structure of claim 1, further comprising a plurality of different connectors that comprises a set of 5-way connectors and a set of 6-way connectors to connect together a plurality of shell struts of the geodesic shell, a set of 4-way connectors to connect some of the shell struts of the geodesic shell to a foundation of the hybrid geodesic structure, and a set of modified 6-way connectors to connect others of shell struts of the geodesic shell to the core structure at the upper extent.

8. The hybrid geodesic structure of claim 1, wherein first ends of the vertical posts originate in a foundation of the hybrid geodesic structure, the vertical posts extending to a height above the upper extent of the geodesic shell at second ends opposite the first ends.

9. The hybrid geodesic structure of claim 1, wherein the set of structural members comprises one or more of a first set of horizontal beams being located at second ends of the vertical posts above the upper extent of the geodesic shell, a second set of horizontal struts being located in line with the upper extent of the geodesic shell, a third set of horizontal beams being located to delineate a first level from a second level of the core structure, and a fourth set of horizontal beams being located in the foundation at first ends of the vertical posts.

10. A hybrid geodesic structure comprising;

a geodesic shell having a 2V-style and that comprises triangular shell components; and a pentagonal core structure extending from a foundation of the hybrid geodesic structure through an upper extent of the geodesic shell to a height above the geodesic shell, the pentagonal core structure supporting the geodesic shell at the upper extent and comprising a first level adjacent to the foundation and a second level above the first level in a center of the geodesic shell, the pentagonal core structure further comprising a set of structural members interconnecting with vertical posts of the pentagonal core structure along a vertical length of the vertical posts to form a horizontal structural ring.

11. The hybrid geodesic structure of claim 10, wherein the second level of the pentagonal core structure comprises a loft living space, a roof and a window.

12. The hybrid geodesic structure of claim 11, wherein the first level of the pentagonal core structure comprises components of one or more of an electrical system, a mechanical system, a water system, and a sewage system.

13. The hybrid geodesic structure of claim 12, wherein a living space surrounds the first level of the pentagonal core structure within the geodesic shell.

14. The hybrid geodesic structure of claim 10, wherein the geodesic shell is attached to the pentagonal core structure at the upper extent using modified 6-way connectors that attach struts of the geodesic shell to vertical posts and horizontal struts of the pentagonal core structure.

15. The hybrid geodesic structure of claim 10, wherein the triangular shell components comprise shell struts in a lattice of shell triangles, about forty triangular shell panels attached to the shell struts, and about twenty-six connectors connecting the shell struts together, connecting the shell struts to the foundation and connecting the shell struts to the pentagonal core structure.

16. The hybrid geodesic structure of claim 10, wherein the triangular shell components comprise a plurality of shell struts arranged in a geodesic lattice and a plurality of triangular shell panels attached to the geodesic lattice of shell struts, the triangular shell panels being in about two sizes and comprising a modified structural insulated panel.

17. The hybrid geodesic structure of claim 10, further comprising living infrastructure equipment (LIFE) to substantially supplant public utilities, wherein components of the LIFE are located at the first level of the pentagonal core structure.

18. A hybrid geodesic kit comprising;

structural components to form a geodesic shell; and structural materials to form a polygonal core structure comprising a roof, wherein the geodesic shell structural components are to surround the core structure, the structural materials of the core structure comprise posts that are to be assembled to extend vertically from a foundation below the geodesic shell to a height above an upper extent of the geodesic shell in a center of the geodesic shell, and a set of structural members to be interconnected with the posts along a vertical length of the posts to form a horizontal structural ring, the roof to be above the geodesic shell, and wherein the core structure is to support the geodesic shell at the upper extent of the geodesic shell.

19. The hybrid geodesic kit of claim 18, further comprising one or both of an exterior finishes package and an interior finishes package.

20. The hybrid geodesic kit of claim 18, wherein the geodesic shell is a 2V-style, the core structure is to be a pentagonal core structure, the geodesic shell is to provide a main level living space surrounding the core structure, the core structure is to provide a first level utility space at the main level and a second level living space.

* * * * *